US010794673B2

(12) United States Patent
Rastegar et al.

(10) Patent No.: US 10,794,673 B2
(45) Date of Patent: Oct. 6, 2020

(54) VERY LOW POWER ACTUATION DEVICES

(71) Applicants: Jahangir S Rastegar, Stony Brook, NY (US); Jacques Fischer, Sound Beach, NY (US)

(72) Inventors: Jahangir S Rastegar, Stony Brook, NY (US); Jacques Fischer, Sound Beach, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 429 days.

(21) Appl. No.: 15/482,737

(22) Filed: Apr. 8, 2017

(65) Prior Publication Data

US 2017/0343328 A1 Nov. 30, 2017

Related U.S. Application Data

(62) Division of application No. 13/869,934, filed on Apr. 24, 2013, now Pat. No. 9,618,305.

(60) Provisional application No. 61/637,829, filed on Apr. 24, 2012.

(51) Int. Cl.
*F42B 10/64* (2006.01)
*F42B 10/18* (2006.01)

(52) U.S. Cl.
CPC ..... *F42B 10/64* (2013.01); *F42B 10/18* (2013.01)

(58) Field of Classification Search
CPC ..... F24B 10/14; F24B 10/18; F24B 10/20; F24B 10/60; F24B 10/62; F24B 10/64; F24B 30/10; F24B 30/12; C06D 5/00
USPC ..... 244/3.24, 3.27
See application file for complete search history.

(56) References Cited

U.S. PATENT DOCUMENTS 3,104,081 A * 9/1963 Arnett ..... B64C 13/00 244/3.21
3,154,015 A * 10/1964 Muller ..... F42B 10/64 244/3.21
3,272,124 A * 9/1966 Marsh ..... F42B 10/64 244/3.21
3,711,040 A * 1/1973 Carver ..... F42B 10/64 244/3.21
4,659,036 A * 4/1987 Pinson ..... F42B 10/14 244/3.22
5,293,811 A * 3/1994 DeLair ..... F42B 10/64 92/49
6,446,906 B1 * 9/2002 Voigt ..... B64C 9/36 244/3.27
6,880,780 B1 * 4/2005 Perry ..... F42B 10/14 244/3.27

(Continued)

*Primary Examiner* — Richard R. Green
*Assistant Examiner* — Brady W Frazier

(57) ABSTRACT

A munition including: a control surface actuation device including: an actuator comprising two or more pistons, each of the pistons being movable between an extended and retracted position, the retracted position resulting from an activation of each of the two or more pistons; and a rotatable plate having a pocket corresponding to each of the two or more pistons, each pocket being engageable with a corresponding portion of each of the two or more pistons, a distance between the pockets being different than a distance between the portions of the two or more pistons, such that activation of the portion into the corresponding pocket sequentially rotates the plate; and a control surface operatively connected to the plate such that rotation of the plate rotates the control surface.

5 Claims, 28 Drawing Sheets

(56) References Cited

U.S. PATENT DOCUMENTS 6,905,093 B2 * 6/2005 Dryer ..... F42B 10/14
244/3.28

* cited by examiner

VERY LOW POWER ACTUATION DEVICES

CROSS REFERENCE TO RELATED APPLICATION

This application is a Divisional Application of U.S. patent application Ser. No. 13/869,934, filed on Apr. 24, 2013, now U.S. Pat. No. 9,618,305, which claims the benefit of earlier filed U.S. Provisional Application No. 61/637,829, filed on Apr. 24, 2012, the entire contents of each of which is incorporated herein by reference. This application is related to U.S. patent application Ser. No. 13/542,635, filed on Jul. 5, 2012, now U.S. Pat. No. 9,228,815, the contents of which is also incorporated herein by reference.

GOVERNMENT RIGHTS

This invention was made with Government support under contract W15QKN-12-C-0008 awarded by the United States Army. The Government has certain rights in the invention.

BACKGROUND OF THE INVENTION

1. Field of the Invention

The present invention relates generally to very low-power actuation devices and more particularly to very low-power actuation devices for guided gun-fired munitions and mortars that can be scaled to any caliber munitions, including medium and small caliber munitions.

2. Prior Art

Since the introduction of 155 mm guided artillery projectiles in the 1980's, numerous methods and devices have been developed for actuation of control surfaces for guidance and control of subsonic and supersonic gun launched projectiles. The majority of these devices have been developed based on missile and aircraft technologies, which are in many cases difficult or impractical to implement on gun-fired projectiles and mortars. This is particularly true in the case of actuation devices, where electric motors of various types, including various electric motor designs with or without gearing, voice coil motors or solenoid type actuation devices, have dominated the guidance and control of most guided weaponry.

Unlike missiles, all gun-fired and mortar projectiles are provided with initial kinetic energy through the pressurized gasses inside the barrel and are provided with flight stability through spinning and/or fins. As a result, they do not require in-flight control action for stability and if not provided with trajectory altering control actions, such as those provided with control surfaces or thrusters, they would simply follow a ballistic trajectory. This is still true if other means such as electromagnetic forces are used to accelerate the projectile during the launch or if the projectile is equipped with range extending rockets. As a result, unlike missiles, control inputs for guidance and control is required only later during the flight as the projectile approaches the target.

In recent years, alternative methods of actuation for flight trajectory correction have been explored, some using smart (active) materials such as piezoelectric ceramics, active polymers, electrostrictive materials, magnetostrictive materials or shape memory alloys, and others using various devices developed based on micro-electro-mechanical (MEMS) and fluidics technologies. In general, the available smart (active) materials such as piezoelectric ceramics, electrostrictive materials and magnetostrictive materials (including various inch-worm designs and ultrasound type motors) need to increase their strain capability by at least an order of magnitude to become potential candidates for actuator applications for guidance and control, particularly for gun-fired munitions and mortars. In addition, even if the strain rate problems of currently available active materials are solved, their application to gun-fired projectiles and mortars will be very limited due to their very high electrical energy requirements and the volume of the required electrical and electronics gear. Shape memory alloys have good strain characteristics but their dynamic response characteristics (bandwidth) and constitutive behaviour need significant improvement before becoming a viable candidate for actuation devices in general and for munitions in particular.

The currently available actuation devices based on electrical motors of various types, including electrical motors, voice coil motors and solenoids, with or without different gearing or other mechanical mechanisms that are used to amplify motion or force (torque), and the aforementioned recently developed methods and devices (based on active materials, such as piezoelectric elements, including various inch-worm type and ultrasound type motors), or those known to be under development for guidance and control of airborne vehicles, such as missiles, have not been shown to be suitable for gun-fired projectiles and mortars. This has generally been the case since almost all available actuation devices that are being used or are considered for use for the actuation of control surfaces suffer from one or more of the following major shortcomings for application in gun-fired projectiles and mortars:

1. High power requirement for electrical motors and solenoids of different types (irrespective of the mechanical mechanisms that are used to transmit force/torque to the control surfaces), as well as for actuators based on active materials, such as piezoelectric materials and electrostrictive materials and magnetostrictive materials (including various inch-worm designs and ultrasound type motors) and shape memory based actuator designs.
2. Limited dynamic response, i.e., limited peak force or torque and limited actuation speed at full load (equivalent to "bandwidth" in linear control systems), considering the dynamics characteristics of gun-fired projectiles and mortars.
3. Electrical motors of different types and solenoid type actuation devices occupy large volumes in munitions. The volume requirement also makes such electrical actuation devices impractical for medium to small caliber munitions applications.
4. Survivability problems of many of the existing actuation devices at very high setback accelerations of over 50 KG.
5. Reliability of operation post firing, particularly at very high setback accelerations of over 50 KG.
6. The high cost of the existing technologies, which results in very high-cost rounds, thereby making them impractical for large-scale fielding.
7. Relative technical complexity of their implementation in gun-fired projectiles and mortars for control surface actuation.

A need therefore exists for the development of innovative, low-cost technologies that address the aforementioned limitations of currently available control surface actuation devices in a manner that leaves sufficient volume inside munitions for sensors, guidance and control, and communications electronics and fusing, as well as the explosive payload to satisfy the lethality requirements of the munitions.

Such control surface actuation devices must consider the relatively short flight duration for most gun-fired projectiles and mortar rounds, which leaves a very short period of time within which trajectory correction/modification has to be executed. This means that such actuation devices must provide relatively large forces/torques and have very high dynamic response characteristics ("bandwidth").

The control surface actuation device applications may be divided into two relatively distinct categories. Firstly, control surface actuation devices for munitions with relatively long flight time and in which the guidance and control action is required over relatively longer time periods. These include munitions in which trajectory correction/modification maneuvers are performed during a considerable amount of flight time as well as within a relatively short distance from the target, i.e., for terminal guidance. In many such applications, a more or less continuous control surface actuation may be required. Secondly, control surface actuation devices for munitions in which the guidance and control action is required only within a relatively short distance to the target, i.e., only for terminal guidance purposes.

Such actuation devices must also consider problems related to hardening of their various components for survivability at high firing accelerations and the harsh firing environment. Reliability is also of much concern since the rounds need to have a shelf life of up to 20 years and could generally be stored at temperatures in the range of −65 to 165 degrees F.

In addition, for years, munitions developers have struggled with the placement of components, such as sensors, processors, actuation devices, communications elements and the like within a munitions housing and providing physical interconnections between such components. This task has become even more difficult with the increasing requirement of making gun-fired munitions and mortars smarter and capable of being guided to their stationary and moving targets. It is, therefore, extremely important for all guidance and control actuation devices, their electronics and power sources not to significantly add to the existing problems of integration into the limited projectile volume.

SUMMARY OF THE INVENTION

Three classes of novel high force/torque and high dynamic response ("bandwidth") control surface actuation devices that are particularly suitable for gun-fired projectiles, mortars and small missiles (collectively referred to as projectiles or munitions) and that can be scaled to any caliber munitions, including medium and small caliber munitions are described herein.

A first class of actuation devices provides a limited number of actuation steps (of the order of 50-100 steps at minimum), making them suitable for terminal guidance, i.e., for operation during the last few seconds of the flight, with the main advantage of occupying a very small volume. A second class of actuation devices provide a nearly continuous actuation motion to the intended control surface for use during a major portion of the flight. A third class corresponds to actuation devices that provide a limited number of actuation actions and are used to tilt the projectile nose and which are particularly suitable for small and medium caliber guided munitions.

The three classes of novel control surface actuation devices can be used for actuation of various types of control surfaces, whether they require rotary or linear actuation motions, such as fins and canards or the like. Two classes of the proposed actuation device concepts are particularly suited for providing high force/torque at high speeds for bang-bang feedback guidance and control of munitions with a very high dynamic response characteristic. As a result, the guidance and control system of a projectile equipped with such control surface actuation devices should be capable of achieving significantly enhanced precision for both stationary and moving targets.

The novel actuator concepts disclosed herein occupy minimal volume since they are powered by the detonation of gas generating charges to generate pressurized gas for pneumatic operation of the actuating devices (the first class of actuation devices) or by detonation of a number of gas generating charges embedded in the actuation device "cylinders" to provide for the desired number of control surface actuation (the second class of actuation devices). As a result, the second class of control surface actuation devices can provide a limited number (e.g., 50-100) of control surface actuations, but with actuating forces/torques on an order of magnitude larger than those possible by electrical and pneumatic systems. With such novel control surface actuation technology, since solid gas generating charges have energy densities that are orders of magnitude higher than the best available batteries, a significant total volume savings is also obtained by the elimination of batteries that are required to power electrically powered actuation devices. It is also noted that the gas generating charges of the actuator devices are intended to be electrically initiated, but such initiation devices utilize less than 3 mJ of electrical energy. The first class of actuation devices also require electrical energy for the operation of their pneumatic valves, but such small solenoid operated valves are available that require only minimum power, such as around 3 mJ, to operate.

The control surface actuation devices are capable of being embedded into the structure of the projectile, mostly as load bearing structural components, thereby occupying minimal projectile volume. In addition, the actuation devices and their related components are better protected against high firing acceleration loads, vibration, impact loading, repeated loading and acceleration and deceleration cycles that can be experienced during transportation and loading operations.

The very low-power control surface actuation devices can be scaled to any caliber gun-fired munitions and mortars; including 155 mm artillery and 81 mortar rounds as well as gun-fired projectiles as small as 60 mm and 25 mm medium and small caliber munitions. The power requirement for the actuation devices is to be orders of magnitude less than electrical motor-based actuation devices; reducing electrical energy requirement from KJ to mJ, i.e., to less than a fraction of 1% of the electrical energy required by electric motors and solenoid type devices.

Unlike actuation devices based on electrical motors of various types, including voice coil motors and solenoids, the novel actuation devices are very low-volume and are powered with high-energy gas-generating energetic material, thereby requiring a significantly reduced volume for power source (battery, capacitor, etc.).

Unlike electrically actuated devices, the control surface actuation devices require power only during the control surface actuation since they can be designed to lock the control surface following actuation, thereby requiring zero power to hold the control surfaces in a given position, therefore significantly reducing the actuation power requirement.

In addition to proving very low-power and low-volume control surface actuation solution for munitions, the novel actuator devices also address other shortcomings of currently used actuation devices, including: 1) the limited dynamic response; 2) survivability under very high setback accelerations of over 50 KGs; 3) limitations in scalability to different caliber munitions; and 4) being costly to implement.

The control surface actuation devices can be readily designed to produce forces of 100-2000 N or higher and torques of 1-10 N-m and higher, and for actuation via charge detonation with fast acting initiation devices, to generate peak force and torque well within 1-10 msec, thereby providing very high dynamic response characteristics.

The actuation devices may be integrated into the structure of the projectile as load bearing structures, thereby significantly reducing the amount of volume that is occupied by the actuation devices.

Due to their integration into the structure of the projectile and their novel design, the novel actuator devices can be readily hardened to survive very high-g firing loads, very harsh environment of firing, and withstand high vibration, impact and repeated loads. The actuator devices will, therefore, lead to highly reliable actuation devices for gun-fired projectiles and mortars.

The novel actuator devices are very simple in design, and are constructed with very few moving parts and no ball/roller bearings or other similar joints, thereby making them highly reliable even following very long storage times of over 20 years.

The novel actuator devices can be designed to conform to any geometrical shape of the structure of the projectile and the available space within the projectile housing.

The novel actuator devices are very simple in design and utilize existing manufacturing processes and components. As a result, the actuation devices provide the means to develop highly effective but low cost guidance and control systems for guided gun-fired projectiles, mortars, rockets as well as gravity dropped weapons.

When desired, the novel actuation devices can be configured to operate using electrical motors or solenoids, while using a fraction of the electrical energy required by current electrically driven actuation devices by taking advantage of the design of the mechanical stepper-motor type actuation mechanisms that eliminates the need to spend power to keep the control-surfaces stationary.

By significantly reducing the power requirement, in certain applications, particularly in small and medium caliber munitions, onboard energy harvesting power sources can be used to thereby totally eliminate the need for onboard chemical batteries. As a result, safety and shelf life of the projectile is also significantly increased.

The novel actuator devices can be used in both subsonic and supersonic projectiles.

BRIEF DESCRIPTION OF THE DRAWINGS

These and other features, aspects, and advantages of the apparatus of the present invention will become better understood with regard to the following description, appended claims, and accompanying drawings where:

FIGS. 3*b* and 3*c* are sectionals of the in-cylinder gas generation device of FIG. 3*a*.

FIG. 4*a* illustrates the control surface actuation system implementation on an 81 mm mortar round while

FIG. 5*a* illustrates the control surface actuation system of FIG. 4*a* following fin deployment while

FIG. 6*a* illustrates a side view of the control system actuation system with deployed fins while

FIG. 10*a* illustrates the continuous control action control surface actuation system on an 81 mm mortar round with a portion of a casing removed for clarity while

FIG. 13*a* illustrates the two-piston continuous control action control surface actuation system implementation on an 81 mm mortar round with a portion of the casing removed for clarity while

DETAILED DESCRIPTION OF THE PREFERRED EMBODIMENT

Figure 1:
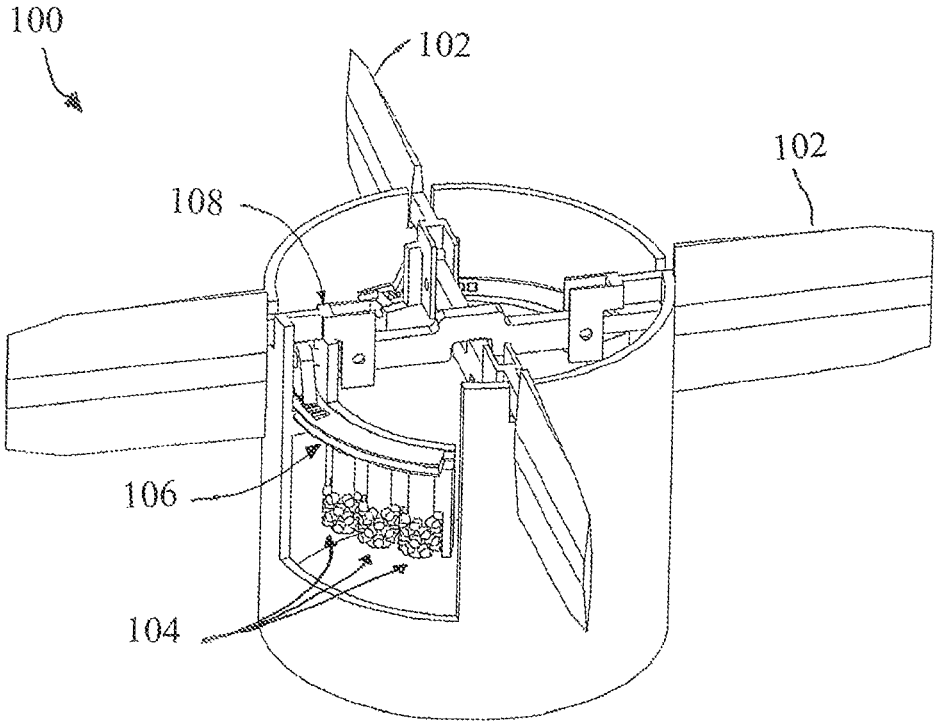
FIG. 1 illustrates an embodiment of a structurally-integrated control surface actuator with built-in gas generating charge sources.
Figure 2:
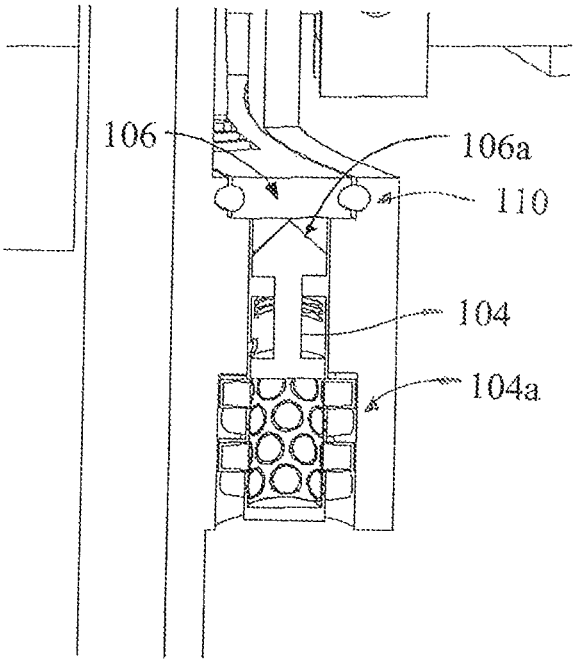
FIG. 2 illustrates a sectional view of the actuation piston and canard actuation rack and pinion mechanism of FIG. 1.

The novel structurally-integrated control surface actuators belonging to the aforementioned first class of actuation devices are presented with reference to FIGS. 1-3. A configuration of such control surface actuation devices, as applied to a 120 mm round for canard actuation is shown in FIG. 1, generally referred to by reference numeral 100. The configuration is described followed by its implementation to an 81 mm mortar round for fin actuation, clearly illustrating the achievement of a very small volume, simple, easy to manufacture and thereby low-cost actuation system.

Figures 3A, 3B, 3C:
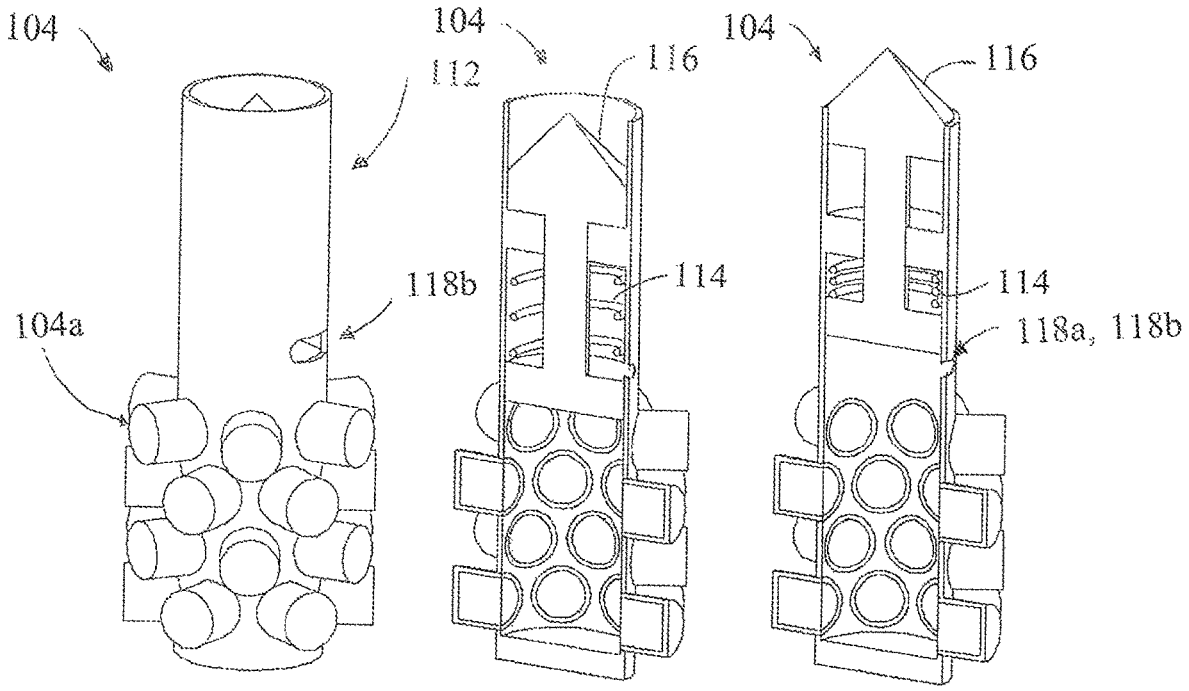
FIGS. 3*a*-3*c* illustrates details of in-cylinder gas generation device where

The canard actuation device 100 is discussed with regard to FIGS. 1-3. Two pairs of deployable canards 102, each using a 3-piston actuator 104 with in-cylinder gas generation charges are employed for each pair of in-line canards 102 to achieve independent actuation. Close-up views of one of the pistons 104 is shown in FIGS. 3*a-c*. The mechanical stepper motor progressively imparts motion on an actuator rack 106, and may be driven forward or backward in incremental steps on a ball bearing guide 110, as commanded. The actuator rack 106 includes pockets 106*a* and is connected to the deployable canards through a canard pinion 108 which translates actuator rack motion into canard pitching, such pinions being well known in the art (such as the rack and pinion shown in FIG. 8). Each of the three structurally integrated pistons 104 are movably housed in a cylinder housing 112 (or in a bore in the munition structure) and biased in a retracted position within the cylinder housing 112 by a return spring 114, as shown in FIGS. 3*a* and 3*b*. A tip portion 116 of the pistons 104, as shown in FIG. 3*c*, is configured to fit within the pockets 106*a*, such as by being configured into a conical shape. Each of the pistons 104 employs a plurality of discrete gas generation charges 104*a*, as shown in FIGS. 3*a*-3*c*. Upon the ignition (e.g., electrical) of a charge 104*a*, the generated gas will cause the pressure inside the cylinder to increase and will propel the piston 104 to the extended position against the biasing force of the return spring 114, as shown in FIG. 3*c*.

The three pistons 104 and the pockets 106*a* on the actuator rack 106 are positioned equally distanced apart, with the distance between the pistons 104 being a certain amount larger than the distance between the pockets 106*a*. As a result, by driving the pistons 104 into the pockets 106*a* sequentially and with a proper sequence, the actuator rack 106 can be driven to the right or to the left, each time a third of the distance between two pockets 106*a*. The incremental stepping of the actuator rack 106 is disclosed in U.S. patent application Ser. No. 13/642,635 filed on Jul. 5, 2012, the contents of which is incorporated herein by reference.

As the piston 104 reaches the limit of its travel, the tip portion 116 engages with a pocket 106*a*, thereby imparting an incremental position change to the rack 106. After such engagement (when the piston 104 reached the limit of its travel), an exhaust port (or trailing edge) 118*a* in the piston 104 is aligned with an exhaust port 118*b* on the cylinder 112, thereby venting the cylinder pressure and allowing the return spring 114 to drive the piston from the extended position shown in FIG. 3*c* to the retracted position, as shown in FIGS. 3*a* and 3*b*. If automatic cylinder venting is not desired, an exhaust valve to vent the cylinder pressure upon command from the control system can be utilized. Thus, by sequential initiation of charges 104*a* on the three pistons 104, the rack 106 can be moved incrementally to in turn control the canards 102.

It is noted that the aforementioned charges 104*a* can be initiated electrically by a guidance and control system. Assuming that the canards 102 operate at an upper speed of 20-30 steps per seconds each, for a nominal required initiation electrical energy of 3 mJ, the required electrical energy per second for both canards 102 working at the same time will be 120-180 mJ, i.e., a power requirement of 120-180 mW. Development of electrical initiators that require at most 50 micro-J and are extremely fast acting, would further reduce the required electrical energy to a maximum of 2-3 mJ.

Next, a basic configuration of the above structurally integrated control surface actuation system for terminal guidance on an 81 mm mortar round is presented. This configuration clearly shows the feasibility of achieving very small actuation system volume and also illustrates the ease of its implementation on larger as well as smaller caliber rounds.

Figure 4A:
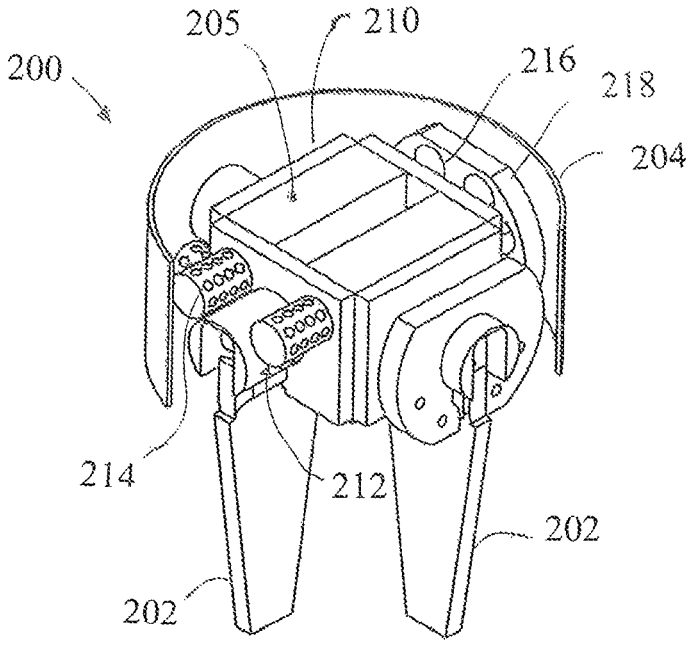
Figure 4B:
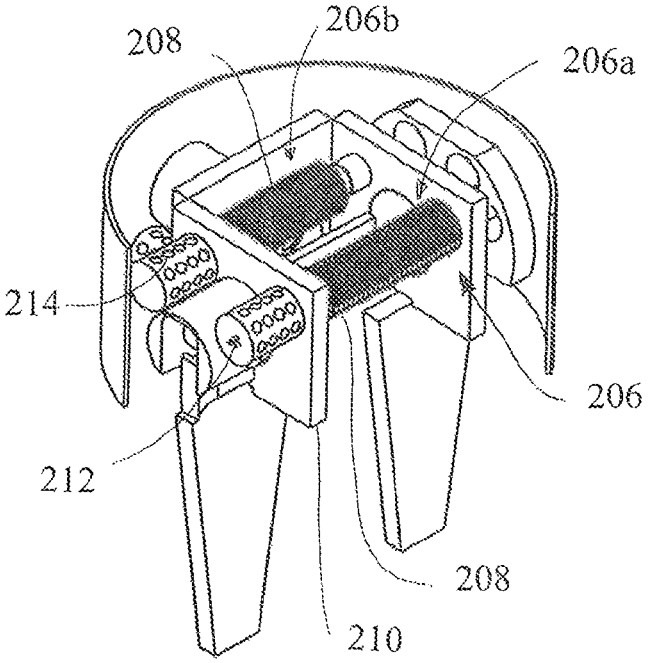
FIG. 4*b* illustrates the control surface actuation system of FIG. 4*a* with components removed for clarity.
Figure 4C:
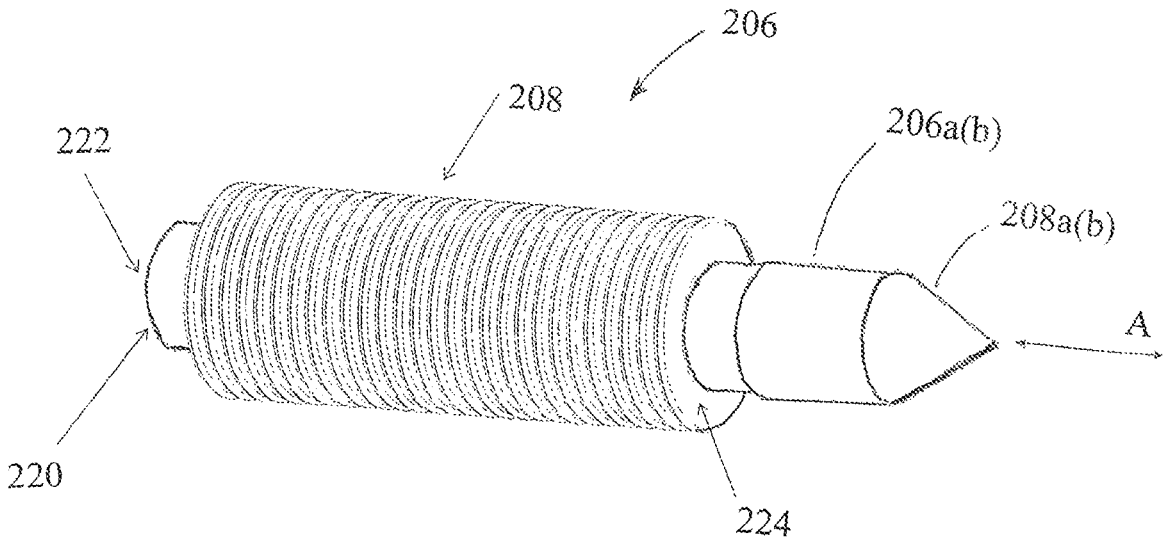
FIG. 4*c* illustrates a perspective view of the bellows-type actuator used in the control surface actuation system of FIG. 4*a*.
Figure 4D:
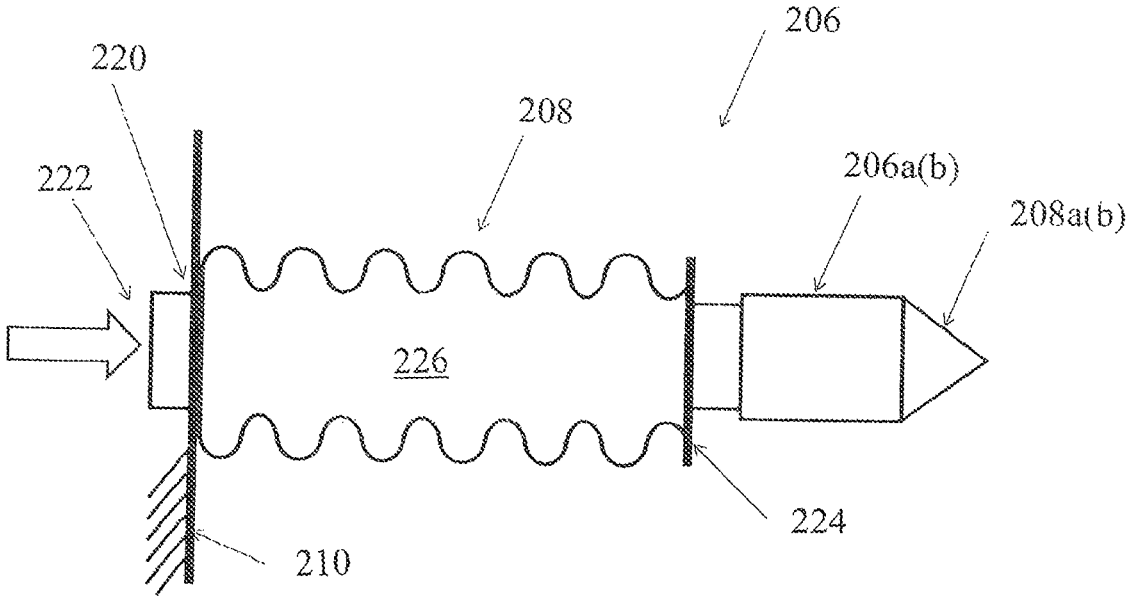
FIG. 4*d* is a section view of the bellows-type actuator of FIG. 4*c*.
Figure 5A:
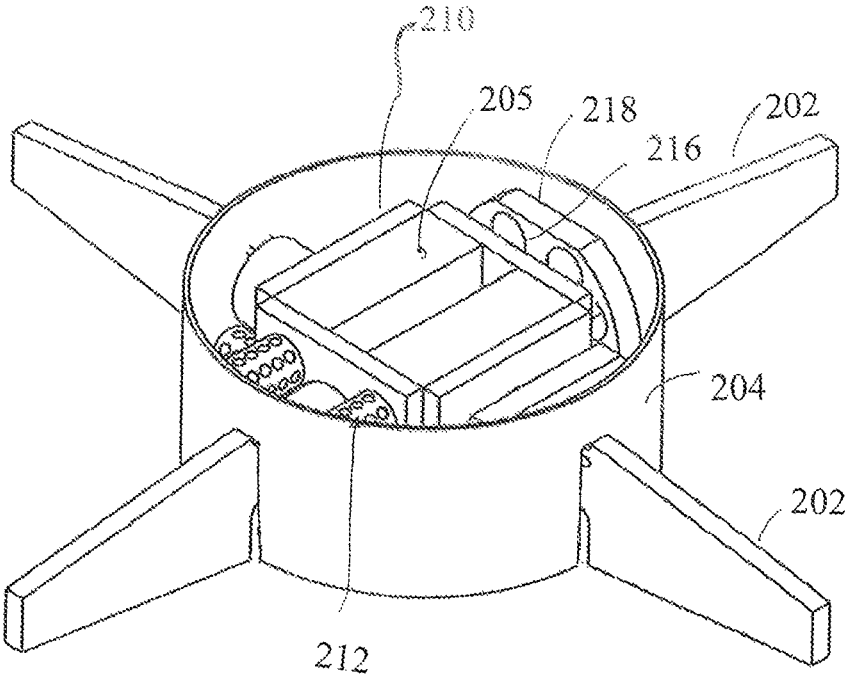
Figure 5B:
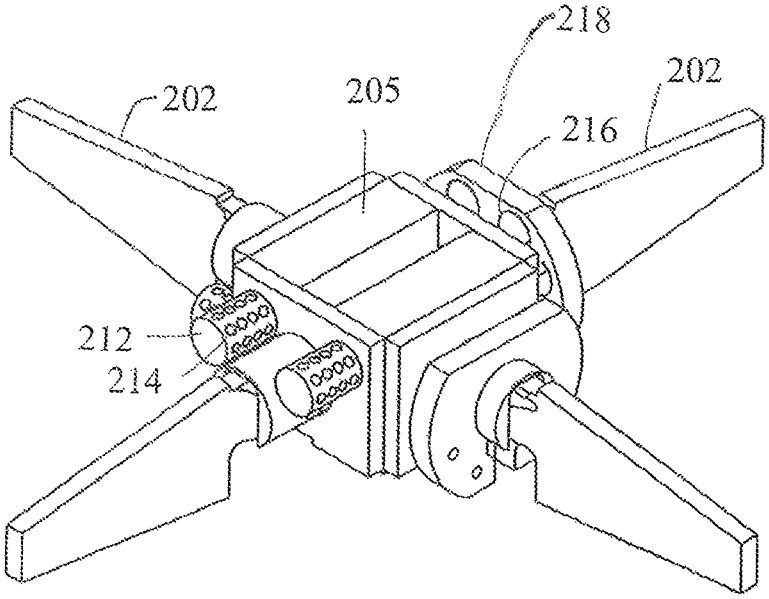
FIG. 5*b* illustrates the control surface actuation system of FIG. 5*a* without an outer casing for clarity.
Figure 6A:
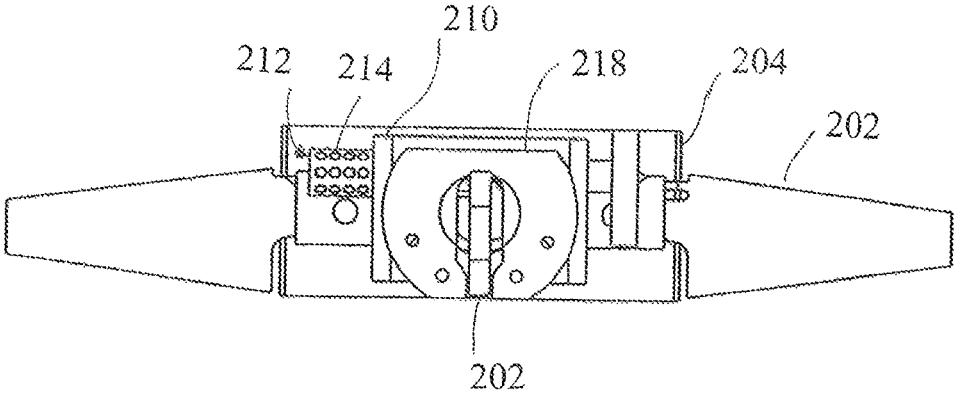
Figure 6B:
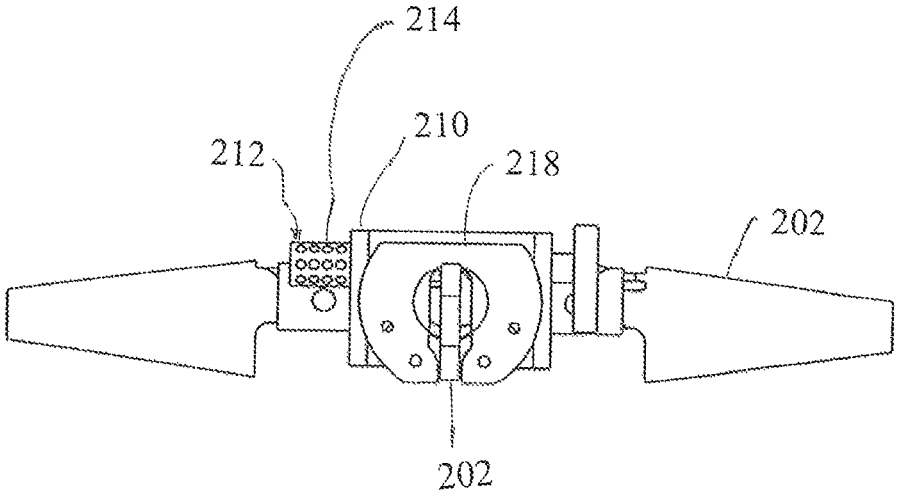
FIG. 6*b* illustrates the control system actuation system with deployed fins of FIG. 6*a* without the outer casing for clarity and FIG. 6*c* illustrates a top view of the control system actuation system of FIG. 6*a* with deployed fins.

In FIG. 4*a*, the terminal guidance control surface actuation system for the 81 mm mortar round (projectile) 200 is shown with the fin pairs 202 in their stored position and a portion of the projectile housing 204 removed to illustrate the various components of the actuation system. In FIG. 4*a*, the main components for both pairs of fin actuation systems are shown. In FIG. 4*b*, a front fin and its actuator components as well as the top cover 205 of the actuation system are removed to show the bellow-type actuators 206. The bellow-type actuator 206 is shown in FIGS. 4*c* and 4*d*. This bellow-type actuator 206 has the advantage of making the actuator device very simple and significantly smaller by eliminating the need for a separate piston with seals that operate in a smooth cylinder. The elimination of the seals also significantly reduces the amount of pressure that is needed to operate the pistons by eliminating the corresponding friction forces. The control surface actuation device system for the 81 mm mortar round following deployment is shown in FIGS. 5*a* and 5*b* (with the projectile housing removed in FIG. 5*b* for clarity). As can be seen in the side views of FIGS. 6*a* and 6*b* (in which the projectile housing is removed in FIG. 6*b* for clarity), the total height occupied by the actuation system is minimal (such as 35 mm in height). In this configuration, only 28 gas generating charges are included in each cylinder of the actuator for the sake of clarity, but the number can be less or even more, such as being over 50 charges per cylinder or more in the same geometrical shapes and size.

Figure 6C:
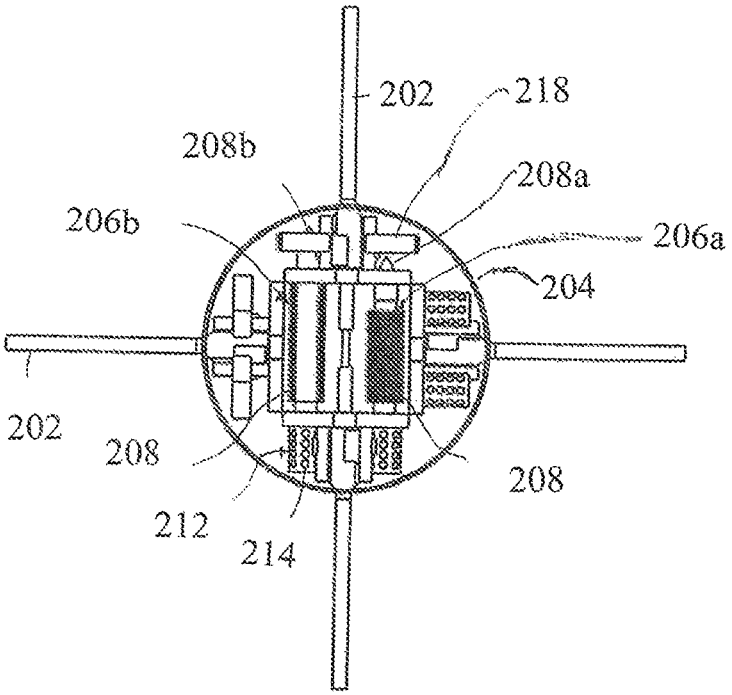

The top view of the control surface actuation system as implemented on an 81 mm mortar round 200 is shown in FIG. 6*c* and can be used together with FIGS. 4*a*, 4*b*, 5*a*, 5*b*, 6*a* and 6*b* to describe its operation as follows. As can be seen in FIG. 4*b*, each bellows-type actuator 206 consists of a bellow 208, which is fixed to the actuator structure 210 and is provided with a base cylinder 212 to which a number of gas generating charges 214 are mounted. Each individual gas generating charge 214 is provided with an electric initiator, which is wired to the projectile guidance and control system (the wiring is not shown for clarity but can be "printed" on the surface of the cylinder over a non-conducting surface as is known in the art). Similarly to that described above, pressure from a generated gas charge expands the bellows 208 in an axial direction (A) to actuate a piston 206*a*, 206*b* (see FIGS. 4*c* and 4*d*).

On the opposite end of the bellow 208, the actuation pin tips 208*a* and 208*b* are provided, which as shown in FIGS. 4*a* and 4*b* face rotor pockets 216 of an actuator rotor 218 (similar arrangements are employed for the other pair of fin actuators which are positioned under the illustrated pair so as to save space). It is noted that the fin actuation system shown in FIGS. 4*a*-6*c* is constructed with two pistons 206 for actuation of each pair of pins, and can thereby provide the means to position the fins in five different orientations, one null (symmetric) position and two clockwise and two counterclockwise rotation angles (with 15-20 degree steps in the illustrated configuration) as described below.

The control surface (fin) actuation device for the 81 mm mortar round shown in FIGS. 4*a*-6*c* operates as follows. Consider the case in which the pair of fins actuated by the pistons 206*a* and 206*b* are configured to be rotated one step in the clockwise direction. In this case, a single charge of the actuator piston 206*b* is ignited, thereby causing the tip 208*b* of the piston to move into the actuator rotor pocket 216, as shown in FIG. 6*c*, causing the fin to rotate one step in the clockwise direction from its symmetric positioning. In such configuration, the tip 208*a* of piston 206*a* is offset with the actuator rotor pocket 216 in front of it (since as described above, the spacing between tips 208*a*, 208*b* is different than the spacing between pockets 216), thereby if actuated, it would cause the actuator rotor 218, and thereby the fin 202, to rotate a second step in the clockwise direction. The fin 202 can then be rotated back to its symmetric positioning by retracting the piston 206*a*, allowing the actuator rotor 218 to be rotated to its symmetric positioning by a preloaded spring (or alternatively the fin 202 can be brought back to its one step clockwise rotation position by actuating the piston 206*b*). By reversing the order of actuator piston actuation, i.e., by actuating the piston 206*a* first and then the piston 206*b*, the fin 202 is rotated one step and then a second step in the counterclockwise direction. The fin 202 may be kept in each position by keeping the actuating piston in the pocket 216 or may be provided with appropriately sized friction pads to resist fin generated torque.

FIGS. 4*a*-6*c* illustrate actuation (in this case rotation) of the fins 202 to provide control surfaces during flight of a projectile. Deployment of the fins from the retracted position shown in FIG. 4*a* to the deployed position shown in FIG. 5*a* can be done by any means know in the art. For example, the fins and canards can be spring loaded in the round and are released upon firing (usually what is keeping them in place is removed as the round exits the barrel, causing them to deploy). Mostly it is a purely mechanical lock which is retracted during launch because the fin has to be deployed right after barrel exit otherwise the round can become unstable.

Referring now to FIGS. 4*c* and 4*d*, there is shown a bellows-type actuator, generally referred to by reference number 206. Although the bellows-type actuator 206 is illustrated as being configured for use with the control surface actuation devices disclosed herein (e.g., as having tip 208*a*), those skilled in the art will recognize that such bellows-type actuator 206 has general utility as an actuator. The bellows-type actuator includes a bellows 208 which is extendable and contractible in direction A. The bellows 208 can also be biased into the retracted position such that it retracts when its interior is not pressurized. A first end 220 of the bellows-type actuator 206 is fixed to the actuator structure 210. The first end can also have a gas inlet 222 in fluid communication with the gas generating charges 214. The other end 224 of the bellows-type actuator is movable along direction A. The bellows 208 has a sealed interior 226 (e.g., ends of the bellows are sealed to the end portions 220 and 224). The actuator piston 206*a*(*b*) is disposed at the other end 224, which can be configured with the tip 208*a*(*b*) for engagement with the actuator rotor pockets 216 of the actuator rotor 218. The bellows-type actuator can be housed in a guide so as to prevent motion other than axial motion (transverse motion).

Figure 7:
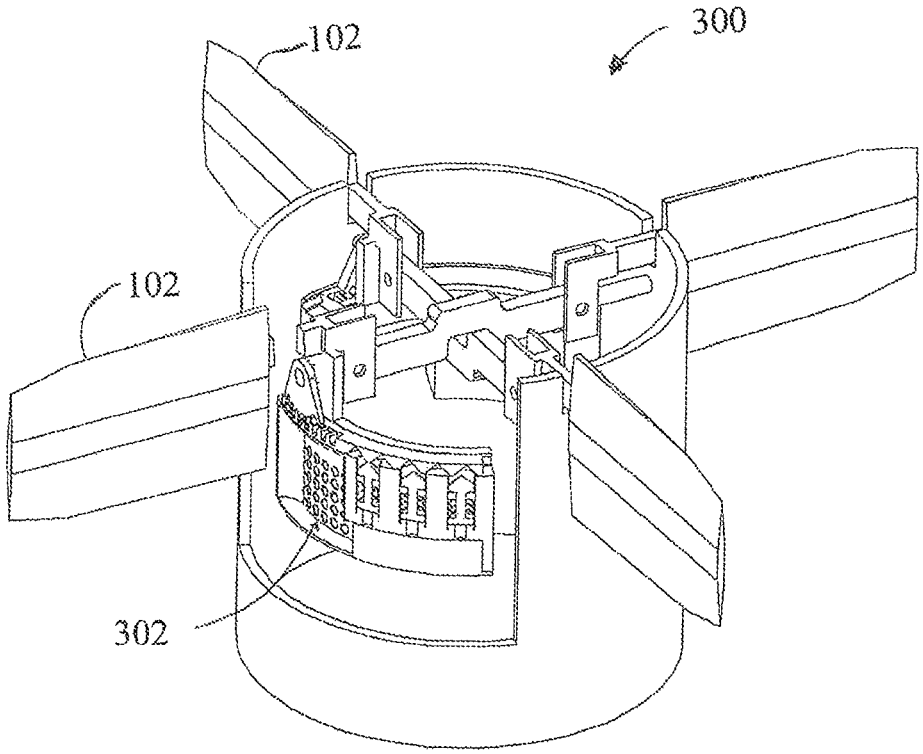
FIG. 7 illustrates a structurally-integrated canard actuation device with pressurized gas generation reservoir for continuous operation having a portion of casing removed for clarity.
Figure 8:
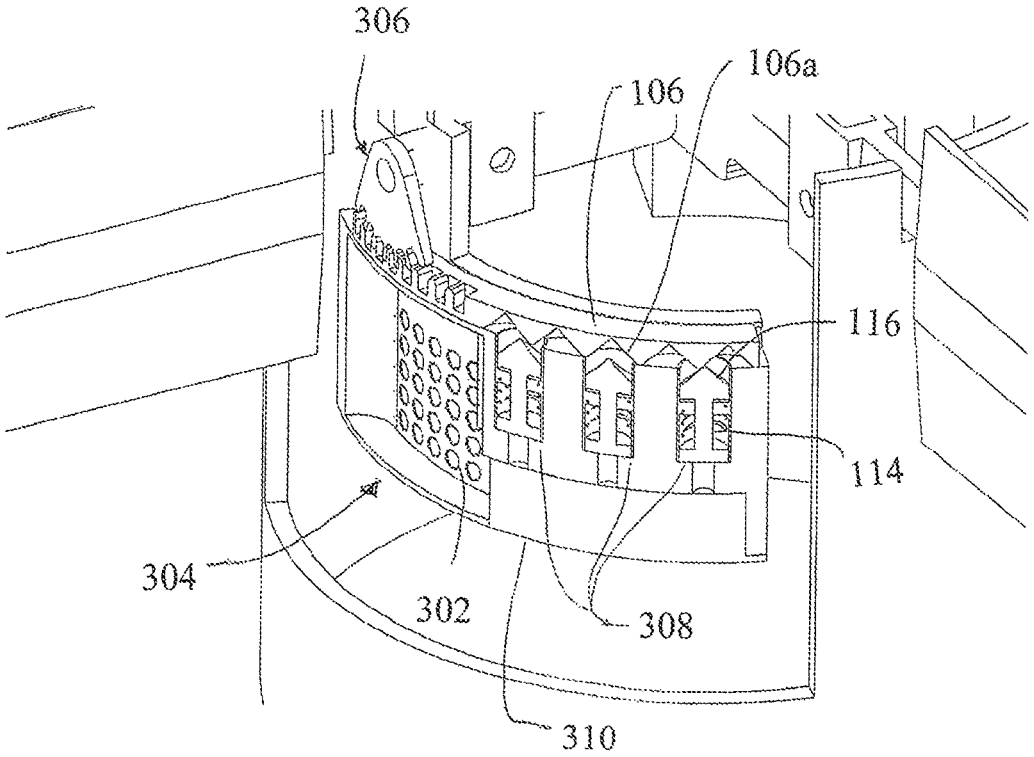
FIG. 8 illustrates a cutaway exterior view of the canard actuation device of FIG. 7 showing various components of the actuation system.
Figure 9:
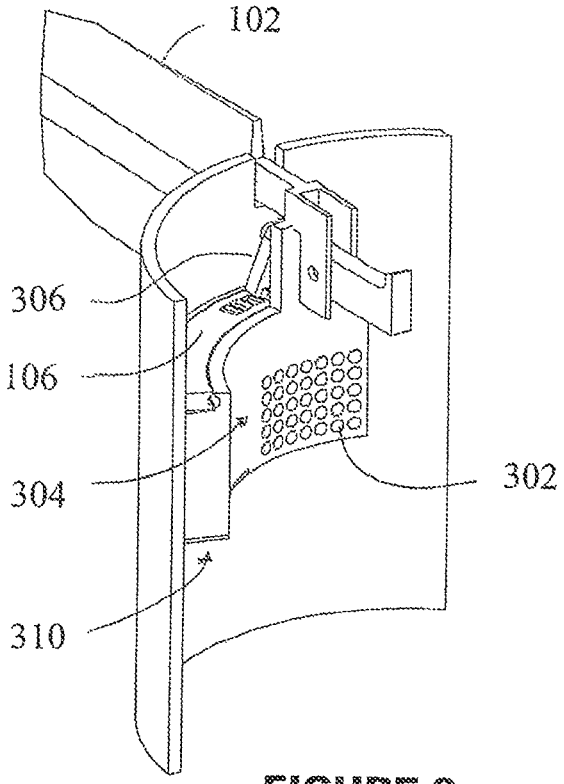
FIG. 9 illustrates a cutaway interior view of the canard actuation device of FIG. 7 showing various components of the actuation system.

In the next description, the structurally-Integrated control surface actuator devices belonging to the aforementioned second class of actuation devices are presented. A configuration of such control surface actuation devices, as applied to a 120 mm round for canard actuation is shown in FIGS. 7-9. Such basic design is described followed by its implementation to an 81 mm mortar round for fin actuation, clearly illustrating the feasibility of achieving a very small volume, simple, easy to manufacture and thereby low-cost actuation system design.

The basic concept as integrated into a 120 mm round for canard actuation is shown in FIG. 7. Two cutaway views are also presented, one showing an outside view (FIG. 8) illustrating the actuation pistons and motion transmitting rack-and-pinion mechanism of the canard, and the other showing the inside view of the canard actuation device (FIG. 9).

FIGS. 7 and 8 show a similarly structurally-integrated canard actuator 300, but instead of in-cylinder gas generation, an array of discrete gas generating charges 302 is located in an adjacent reservoir 304. The individual structurally-integrated actuator pistons 308 are then controlled through a valve body 310 which uses the pressure from the reservoir 304 to drive the pistons 308. Pressure may be developed in the reservoir 304 shortly before anticipated actuation, and then maintained automatically by igniting successive gas generation charges to ensure that pressure to actuate the canards 102 is always available. The canard actuator 300 may be configured with a reservoir for each actuator piston group 308 (as shown), or with a single reservoir to feed multiple piston groups 308 on a single projectile. The ability to employ any number of reservoirs of varying geometry and location may allow for more seamless integration of the complete actuator system into a given munitions.

Similarly to the canard actuator of FIGS. 1, 2 and 3*a*-3*c*, pressure from the gas generating charges extends the piston 308 to force its tip 116 into a pocket 106*a* on the rack 106 against the biasing force of the return spring 114. When the pressure is exhausted, the tip 116 retracts from the pocket 106*a*. In this way, the rack 106 can be moved incrementally to in turn control the canards 102 though pinion 306.

In this section, the implementation of the basic design of the above structurally integrated control surface actuation system for providing a continuous control action for guidance and control of an 81 mm mortar round is presented. This implementation clearly shows the feasibility of achieving very small actuation system volume and also illustrates the ease of its implementation on larger as well as smaller caliber rounds.

Figure 10A:
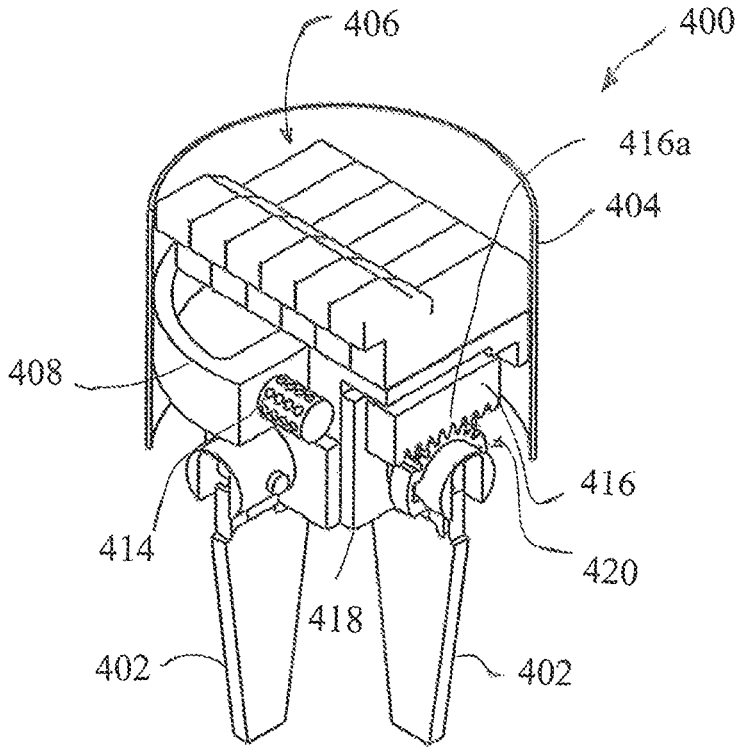
Figure 10B:
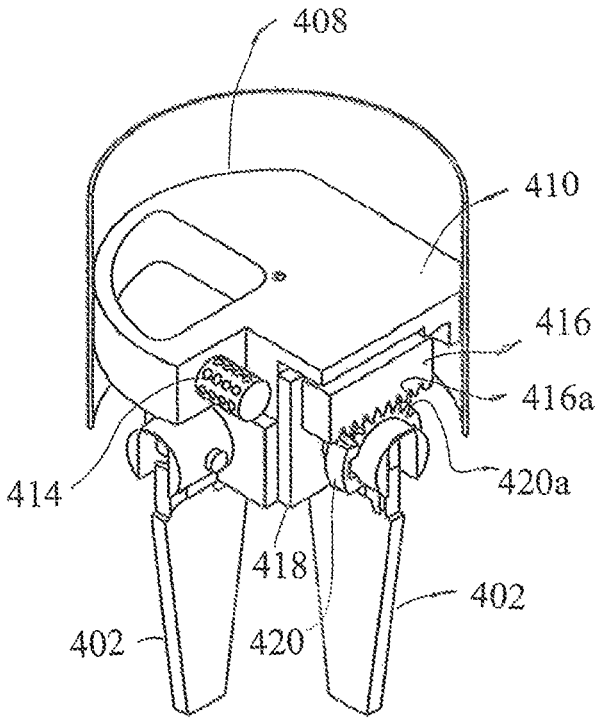
FIG. 10*b* illustrates the continuous control action control surface actuation system of FIG. 10*a* with solenoid valves removed for clarity and FIG. 10*c* illustrates the continuous control action control surface actuation system of FIG. 10*b* with pressurized gas storage reservoir additionally removed for clarity.
Figure 10C:
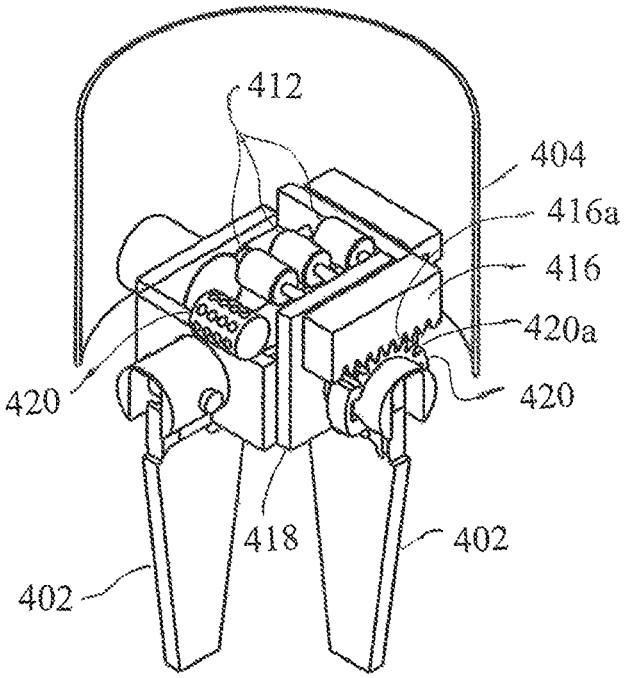

In FIGS. 10*a*-10*c*, the control surface actuation system 400 for continuous control action as implemented on an 81 mm mortar round is shown with the fins 402 in their stored position. The projectile housing 404 in FIGS. 10*a*-10*b* is partially removed to illustrate the various components of the actuation system. In FIG. 10*a*, all main components for both pairs of fin actuation systems are shown. In FIG. 10*b*, the solenoid valves 406 are removed to show the internal components of the system. In FIG. 10*c*, and the pressurized gas storage reservoir 408 and top cover 410 of the actuation system are further removed for clarity. In FIG. 10*c*, three actuation pistons 412 are for the actuation of one pair of fins 402 and the three actuation pistons for actuating the other pair of fins are positioned under them (not visible in FIG. 10*c*). The six solenoid valves 406 can be commercially available and are used to drive each piston 412 with a commanded sequence. In the illustrated configuration, the actuation steps are 5 degrees and the fins can be rotated over 40 degrees in each direction. As can be seen in FIG. 10*c*, the available space besides the actuation pistons can be used to store pressurized gas to operate the actuation system. The pressurized gasses are generated by the ignition of gas generating charges 414. The volume of the pressurized gas storage compartment 408 shown in FIGS. 10*a* and 10*b* can be enough to operate at least 10-15 piston actuations, noting that the storage volume can be further extended to the lower level of the actuator as well and should therefore provide enough pressurized gas storage volume for 20-30 piston actuations. The pressurized gas storage can be provided with a pressure sensor which would instruct ignition of the next gas generating charge when the gas pressure inside the pressurized gas storage compartment 408 drops below a desired limit. The solenoid valves 406 can be commercially available, such as those manufactured by ASCO (Emerson Controls) that operate at 12 Volts, requiring 13 mJ of power to operate at 145 psi of pressure.

It is noted that in the actuation system shown in FIGS. 10*a*-10*c* piston and cylinder type actuation is shown to be used as described previously with the pistons 412 being actuated by a corresponding solenoid 406 which provides pressurized gas from the pressurized gas storage compartment 408 to actuate the piston 412. Each piston 412 having a tip as previously described and the rack 416 having gear teeth 416*a* with pockets spaced differently from the spacing of the piston tips. The fins 402 are rotatably supported on the actuator structure 418 with the fin 402 including a gear 420 having gear teeth 420*a* mating with the gear teeth 416*a* of the rack 416. In operation, the gas charges 414 are selectively initiated (such as being called for by a pressure sensor) to pressurize the pressurized gas storage compartment 408. The solenoids 406 are also selectively initiated to provide pressurized gas from the pressurized gas storage compartment 408 to a corresponding piston 412. Such piston 412 is actuated to extend its tip into a corresponding (but offset) pocket to step the rack 416 in a predetermined direction. The rack 416, in turn, is engaged with the gear 420 to rotate the same and the pair of fins 402 connected thereto.

However, the actuation system 400 can also be configured with the combined bellow-type actuation cylinder and piston design described above. An advantage of the bellow type actuation piston is their smaller size and the elimination of piston seals and the resulting friction forces, which might become an issue for the required shelf life of over 20 years. The only drawback of bellow type actuation device is the elastic resistance (spring rate) of the bellow to displacement, which should be less than the friction forces in piston type cylinders, with the added advantage that the bellow spring rate is very easily measured and is not subject to change whereas friction and stiction forces are nearly random and very hard to predict.

Figure 11:
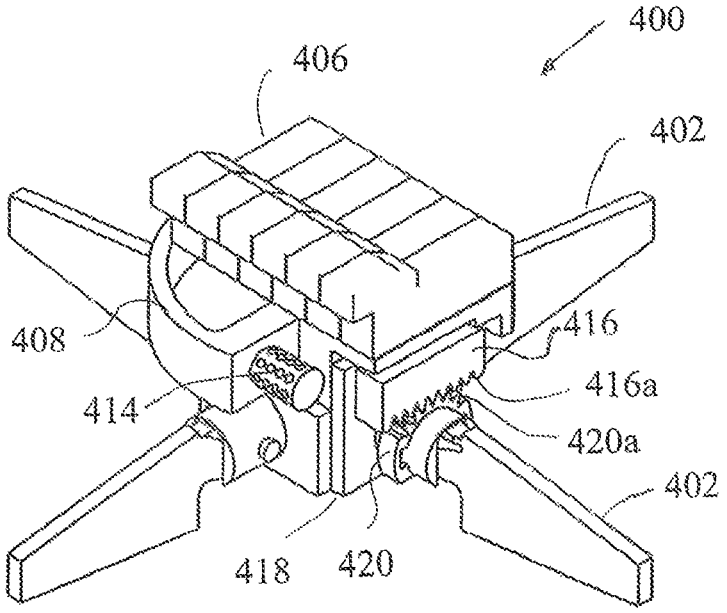
FIG. 11 illustrates the actuation system of FIG. 10*a* following fin deployment.
Figure 12A:
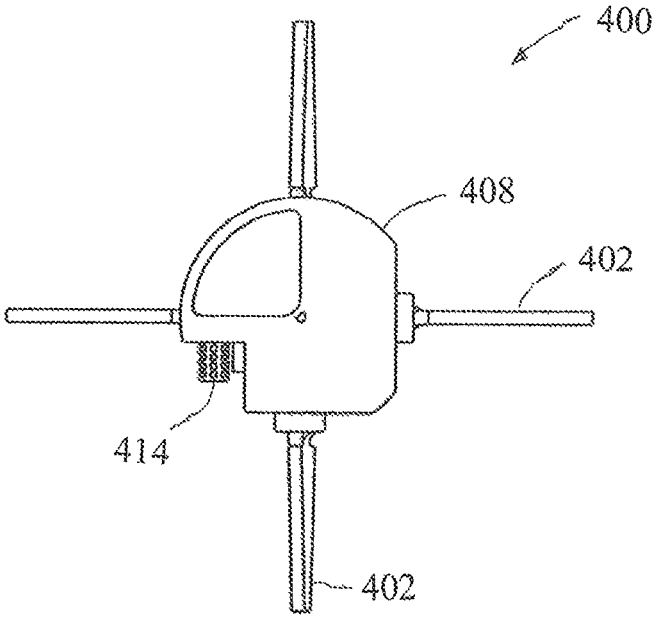
FIGS. 12*a* and 12*b* illustrate side and top views, respectively, of the actuation system of FIG. 10*a* following fin deployment.
Figure 12B:
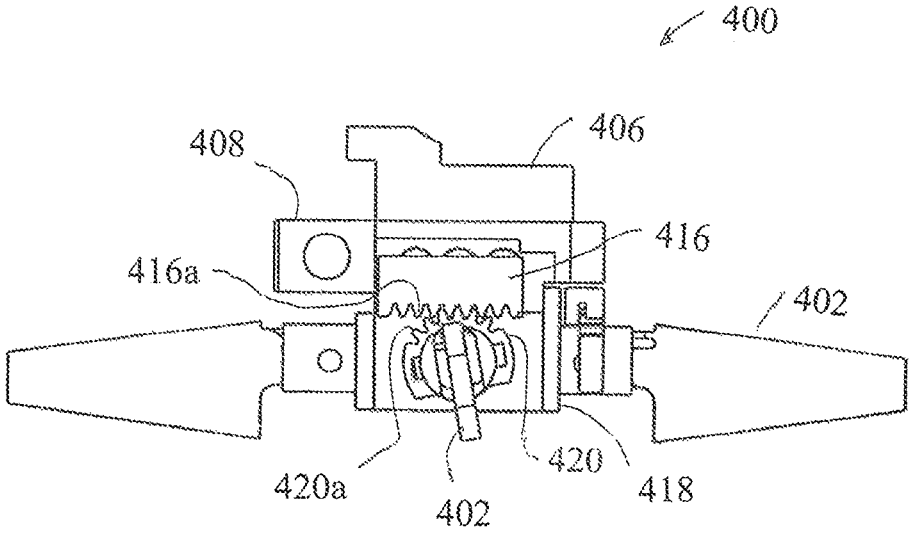

The control surface actuation device system for the 81 mm mortar round following deployment is shown in FIGS. 11, 12*a* and 12*b* (with the housing 404 removed for clarity). As can be seen in FIG. 12*b*, the total height occupied by the actuation system is minimized, such as being 60 mm in height. The increase in height from 35 mm for the previously described terminal guidance actuation device is mainly due to the addition of the control valves 406. It is, however noted that the present design can be optimized, such as with smaller valves that operate at less pressure to achieve the required actuation torques.

As can be seen in FIG. 10*c*, the three actuation pistons 412 are fixed to the actuator structure 418. As discussed above, the pressurized gas reservoir 408 is first charged by igniting one of the several gas generating charges 420. Each individual gas generating charge 420 is provided with an electric initiator, which is wired to the projectile guidance and control system (wiring not shown for clarity but can be "printed" on the surface of the cylinder over a non-conducting surface). From this time on, a pressure sensor is provided which would initiate the next gas generating charge when the reservoir pressure falls below certain limit. Each actuator piston is provided with a tip similar to that (208*a*) shown in FIG. 6*c*, which are similarly facing the rotor pockets of the actuator rack 416, such that their proper sequential actuation would cause the linearly actuating rack 416 of the actuation device to translate one step at a time to the right or to the left. The actuator gear 420, which is directly attached to a rotating shaft of a corresponding fin pair 402 will then rotate in the clockwise or the counterclockwise direction and thereby actuate the fin control surface a desired amount, as is shown in FIGS. 12*a* and 12*b*. It is noted that the fin actuation system shown in FIGS. 10*a*-12*b* is constructed with three pistons 412 for actuation of each pair of fins 402, and can thereby provide the means to rotate the fins 402 in either clockwise or counterclockwise direction one step at a time within its total range of rotation (such as, 40 degrees in either direction with 5 degrees steps) of the system. A near continuous control surface actuation can thereby be achieved. In FIGS. 12*a* and 12*b* the top and side views, respectively, of the actuation system 400 are shown following fin deployment and for example, 3 steps (e.g., 15 degrees) of counterclockwise rotation of the fins.

Figure 13A:
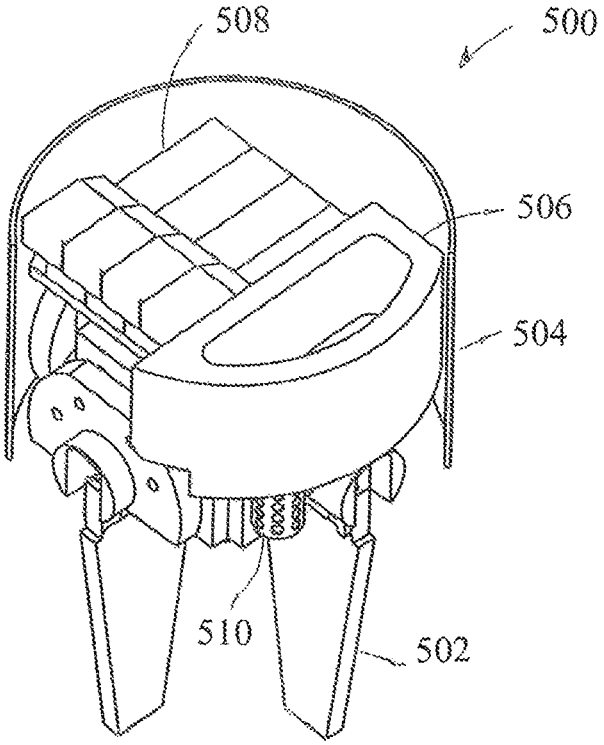

An implementation of the above structurally integrated control surface actuation system for providing a continuous but more discrete control action for guidance and control of a projectile, e.g., an 81 mm mortar round, is now described with regard to FIGS. 13*a*-15*b*. The actuation system 500 shown in FIGS. 13*a*-15*b* provides for five discrete positionings of each pair of fins 502, a symmetric position, and two clockwise and two counterclockwise positions (e.g., each with 15 degrees and 30 degrees angles of rotation) similar to the actuation device 400 described above but which can be operated continuously over the entire projectile flight. The actuation system 500 is shown in FIGS. 13*a* and 13*b* with a portion of the housing 504 removed for clarity and fully removed in FIG. 14. A pressurized gas storage compartment 506, solenoid valves 508 and piston cover are removed in 13*b* for clarity. An advantage of the actuator system 500 shown in FIGS. 13*a*-15*b* over the actuation system of FIGS. 10*a*-12*b* is the smaller size. A possible drawback is the limited number of discrete fin positionings, which should not be an issue for relatively slow subsonic rounds such as mortars and many artillery rounds. This configuration clearly shows the feasibility of achieving very small actuation system volume and also illustrates the ease of its implementation on larger as well as smaller caliber rounds.

Figure 13B:
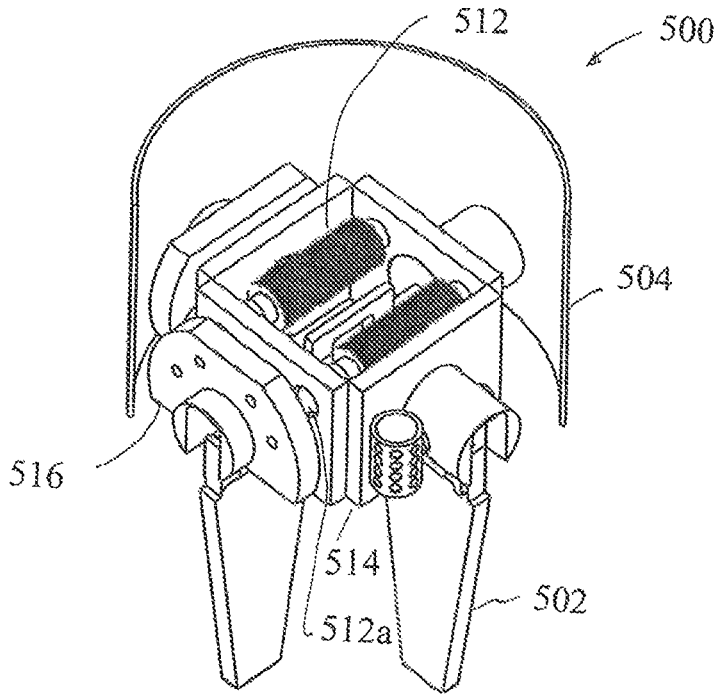
FIG. 13*b* illustrates the actuation system of FIG. 13*a* with components removed for clarity.

In FIG. 13*a*, the control surface actuation system 500 for continuous control action as implemented on an 81 mm mortar round is shown with the fins 502 in their stored position. The four solenoid valves 508 are commercially available and are used to derive each cylinder with the commanded sequence. In the illustrated configuration, the actuation steps can be 15 degrees and the fins can be rotated 30 degrees in each clockwise and counterclockwise direction. As can be seen in FIG. 13*b*, the available space besides the four valves can be used to store pressurized gas in a pressurized gas storage compartment 506 to operate the actuation system. The pressurized gasses are similarly generated by the ignition of gas generating charges 510 in fluid communication with an interior of the pressurized gas storage compartment 506. The volume of the pressurized gas storage compartment 506 shown in FIG. 13*a* is enough to operate at least 15-25 piston actuations, noting that the storage volume can be further extended to the lower level of the actuator as well and should therefore provide enough pressurized gas storage volume for 30-40 piston actuations. The pressurized gas storage can be provided with a pressure sensor which would ignite the next gas generating charge 510 when the gas pressure in the pressurized gas storage compartment 506 drops below a desired limit. The solenoid valves 508 used in this design are commercially available, such as those manufactured by ASCO (Emerson Controls) that operate at 12 Volts, requiring 13 mJ of power to operate at 145 psi of pressure.

Figure 14:
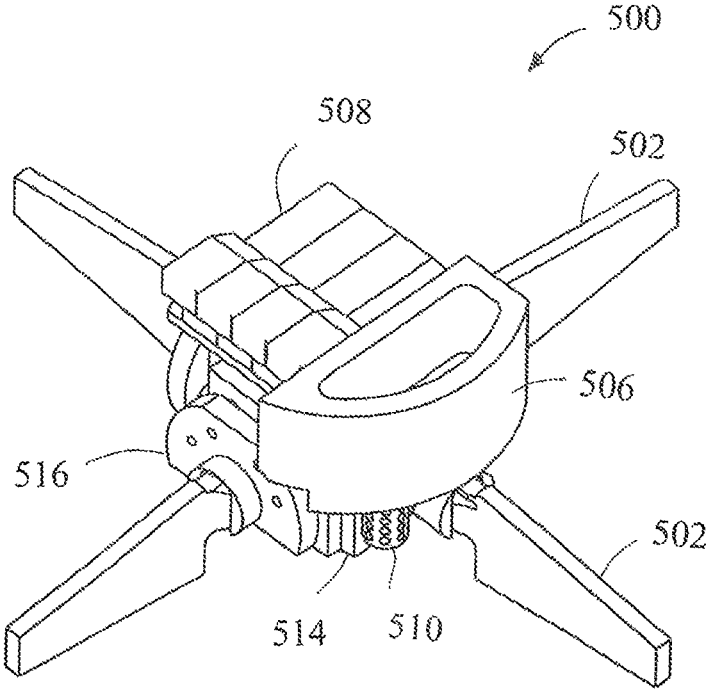
FIG. 14 illustrates the actuation system of FIG. 13*a* following fin deployment.

The control surface actuation system following deployment is shown in FIG. 14. As can be seen in the side view of FIG. 14 (right), the total height occupied by the actuation system is 54 mm. The increase in height from 35 mm for a previously described terminal guidance actuation device is mainly due to the addition of control valves 508. It is, however noted such design can be optimized, such as by using smaller valves that operate at less pressure to achieve the required actuation torques.

In the illustrated configuration, the actuator pistons are constructed with bellow type actuation pistons 512 as was previously described for the actuation system of FIGS. 4*a*-6*c*. A main advantage of the bellow type actuation is the elimination of piston seals and the resulting friction forces, which would be beneficial to meet a required shelf life of over 20 years. A possible drawback of bellow type actuation device is the elastic resistance (spring rate) of the bellow to displacement, which should be less than the friction forces in piston type cylinders, with the added advantage that the bellow spring rate is very easily measured and is not subject to change whereas friction and stiction forces are nearly random and very hard to predict.

It is, however, noted that the elastic resistance (spring rate) of the bellow is in fact useful since it can be used to provide the force that would otherwise have to be provided by return springs of the actuator piston.

Figure 15A:
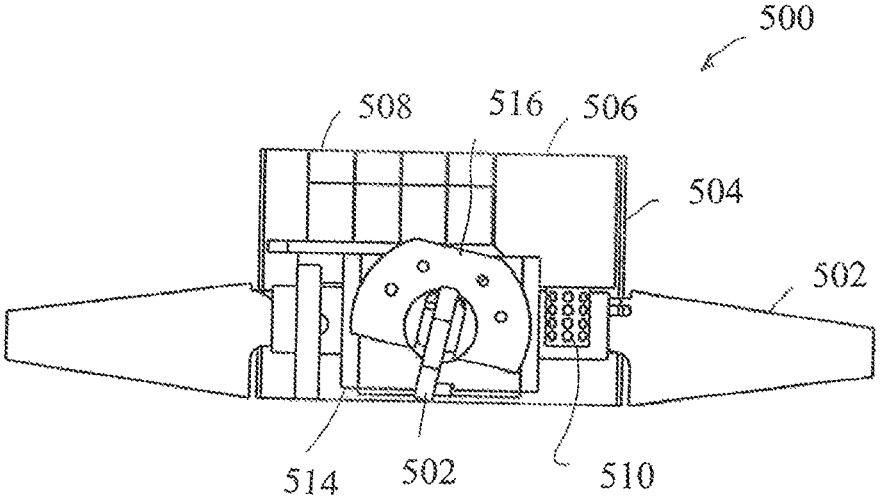
FIGS. 15*a* and 15*b* illustrate side and top views, respectively, of the actuation system of FIG. 13*a* following fin deployment.
Figure 15B:
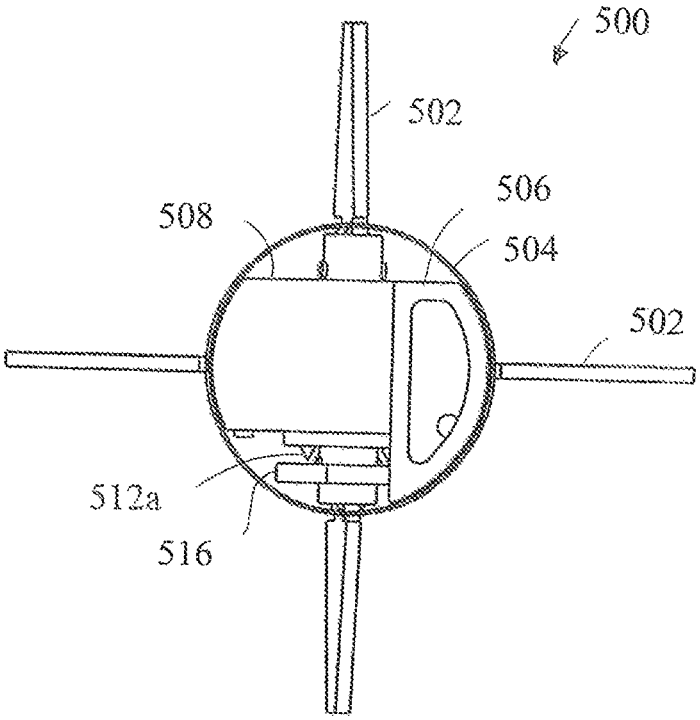

The side and top views, respectively, of the control surface actuation system 500 as implemented on an 81 mm mortar round are shown in FIGS. 15*a* and 15*b* and can be used together with FIGS. 13*a*, 13*b* and 14 to describe the operation of the actuation system 500 as follows. As can be seen in FIG. 13*b*, the two actuation pistons 512 are fixed to the actuator structure 514. The pressurized gas reservoir 506 is first charged by igniting one of the several gas generating charges 510. Each individual gas generating charge 510 is provided with an electric initiator, which is wired to the projectile guidance and control system (wiring not shown for clarity but can be "printed" on the surface of the cylinder over a non-conducting surface). After the initial pressurization, a pressure sensor can be provided which would initiate the next gas generating charge 510 when the reservoir 506 pressure falls below a certain limit. Each actuator piston 512 is provided with a tip 512*a* similar to the actuation pins of FIG. 6*c*, which are similarly facing the rotor pockets of the actuator rotor 516, such that their proper sequential actuation would cause the fin 502 to rotate one or two steps in the clockwise or counterclockwise direction as shown in FIGS. 15*a* and 15*b*.

The configuration illustrated in FIGS. 13*a*-15*b* occupies less volume and requires only two pistons for operation. The fins 502 are held in its neutral (symmetric) position by a spring mechanism which will hold them in place against aerodynamic forces. The actuator is designed such that depending on the sequence of the two actuation piston operation, the fin 502 is rotated in either clockwise or counterclockwise direction. As a result, two successive positions to either side of the neutral position would provide for a total of five positions of the control surface. In addition, due to the presence of the pressurized gas reservoir 506, the fins can be operated during the entire flight as long as enough gas-generating charges are provided to maintain a necessary pressure in the pressurized gas reservoir 506.

Referring now to FIGS. 16*a*-16*c* and 17*a*-17*c*, the novel structurally-integrated control surface actuators belonging to the aforementioned third class of actuation devices, i.e., the actuation devices that are used for direct tilting of the projectile nose are described. Such control surface actuation devices are particularly suitable for small and medium caliber guided munitions, and for providing a limited number of actuation actions for their bang-bang control. However, the actuators may also be used in larger caliber projectiles and to provide a near continuous control surface actuation by incorporating the gas generator reservoir and control valves described for the first class of actuation devices.

Figure 16C:
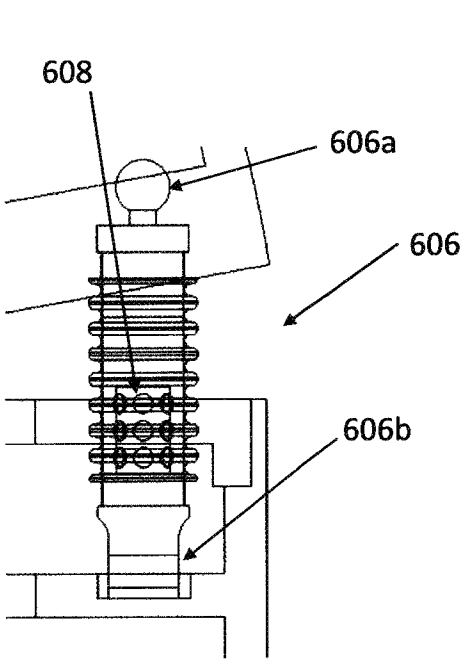
FIGS. 16*a*-16*c* illustrate structurally-integrated projectile nose actuation devices for medium and small caliber rounds.
Figure 16B:
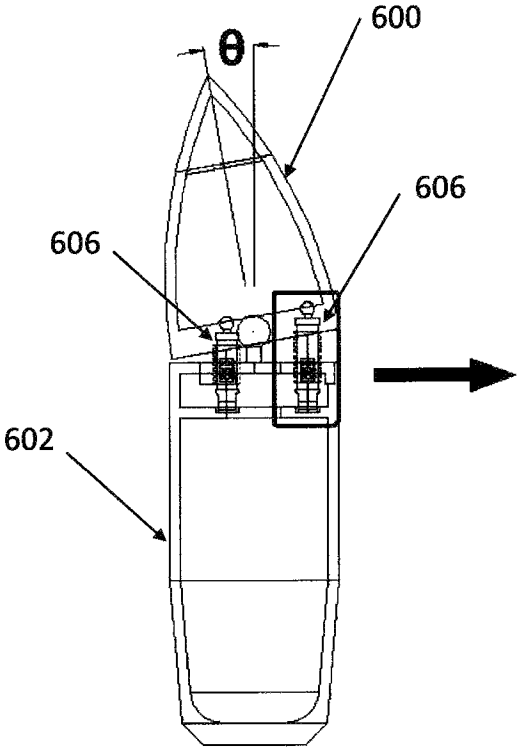
Figure 16A:
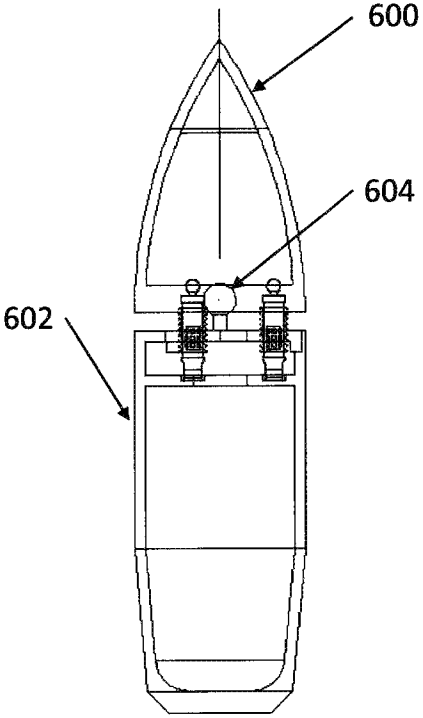

A basic design of control surface actuation devices as implemented in small or medium caliber munitions is shown in FIGS. 16*a*-16*c*. Such design is particularly suitable for medium and small caliber munitions. In this design, the nose section 600 is attached to the munitions body 602 with a centrally positioned ball joint 604, which can be a living joint with the required elastic stiffness to normally keep the nose in its body aligned configuration, as shown in FIG. 16*a*. At least three linear actuation pistons 606 are positioned symmetrically around the nose 600, connected on one side to the nose 600 and on the other side to the round body 602. A close-up view of a typical linear actuation unit is shown in FIG. 16*c*. The linear actuation unit is similar to the actuator pistons described above, having an end 606*a* (actuated by a movable piston in the device 606) rotatably connected to the nose 600 and another end 606*b* fixed to the body 602. Actuation charges 608 are used to create pressurized gas to actuate the piston. By the actuation of the linear actuation unit(s) 606, the piston and end 606*a* are extended to tilt the nose section 600 of the round in the desired direction, as shown in FIG. 16*b*.

It is noted that in the close-up view of FIG. 16*c*, the piston is shown to be attached to the nose section 600 by a spherical joint at the first end 606*a* and to the round body 602 by a pin joint at the other end 606*b*. In practice, however, since the amount of required piston displacement is relatively small and by using bellow type actuation pistons, the need for the indicated spherical and pin joint connections can be eliminated and the actuation piston can be connected directly to the nose section and the round body. This is made possible by the use of bellow type actuation pistons since such bellows allow for a considerable amount of tilting rotation of one end of the piston relative to the other end. As a result, the entire space occupied by the actuation piston assemblies and their connections to the nose section and the round body is significantly reduced.

As can be observed in the close-up view of FIG. 16*c*, the actuation charges 608 for actuating the actuation pistons are positioned inside the bellow itself. This novel approach has a number of advantages over the external positioning of the actuation charges as was shown in the actuators described below and can be used for all such direct actuation charges. An advantage of such positioning of the actuation charges is that it will significantly reduce the total required length of the actuation pistons. Secondly, by eliminating the volume that needs to be pressurized, i.e., by eliminating the volume outside of the bellow due to the added charge section and by reducing the volume inside the below by inserting the charge mounted cylinder as can be observed in FIG. 16*c*, the amount of gas generating charges that are required in order to achieve the desired actuation piston pressure is significantly decreased. An added advantage of reducing the volume of the required individual actuation charges is that it would allow the inclusion of more such charges in the available bellow volume.

It is also noted that in the illustrations of FIGS. 16*a*-16*c*, a considerable amount of gap is shown to be provided between the nose section 600 and the round body 602. This gap is provided in these illustrations only for the sake of clarity and in practice, particularly when using living spherical joints to connect the nose section to the round body and by providing the living joint with enough axial flexibility, the need for such a gap is eliminated and in fact the nose section can be designed to overlap the round body section.

It is noted that by biasing the nose section 600 to return to its normal (round body aligned) configuration, only one actuation piston activation is required for each nose-tilting operation. In general, by using three such actuation pistons 606, the nose 600 can be tilted in three different directions by actuating a single actuator, noting that these actuation devices are in reality on-or-off type of actuation devices. When one actuator 606 is actuated, the tilting of the nose 600 will also slightly bend the other two actuation pistons, which they can readily tolerate due to the flexibility of their bellow structure. By actuating two of the actuation pistons at a time, the nose 600 is tilted in a direction between the two actuated pistons. As a result, by using three actuation pistons 606, the nose section 602 can be tilted in six different directions. Similarly, it is readily seen that by employing four actuation pistons, the nose section 602 of the round can be tilted in twelve different distinct directions by actuating one, two or three actuation pistons at a time.

Figure 17C:
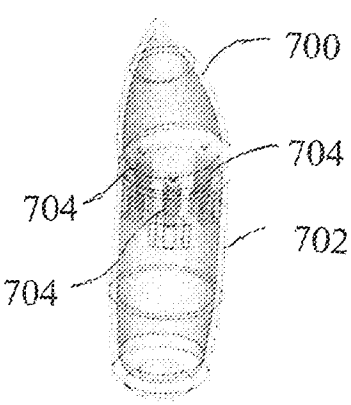
FIGS. 17*a*-17*c* illustrate structurally-integrated projectile nose actuation devices for round nose tilting.
Figure 17B:
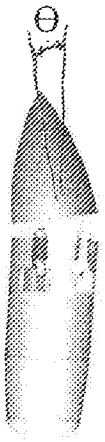
Figure 17A:
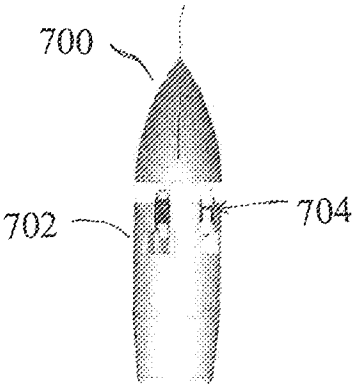

A control surface actuation device presented in the previous section FIGS. 16*a*-16*c* was shown to be more suitable for smaller caliber rounds since for larger caliber sounds the centrally located ball joint would result in relatively large displacement between the nose section and the round body interface. To minimize this displacement, the centrally positioned ball joint can be eliminated and the nose section 700 titled directly by three or more actuation pistons 704 as shown in FIGS. 17*a*-17*b*. Again, at least three linear actuation pistons 704 are positioned symmetrically around the nose 700 as shown in FIG. 17*c*, each connected on one side to the nose section 700 and on the other side to the round body 702. The close-up view of a typical linear actuation unit is as shown in FIG. 16*c*. By the actuation of the proper linear actuation unit(s) 704, the nose section 700 of the round is tilted in the desired direction. As described in the previous section for the nose tilting system of FIGS. 16*a*-16*c*, the use of bellow type actuation pistons allows for the tilting rotation of one end of the piston relative to the other end, and would thereby allow the non-actuated pistons to accommodate the resulting slight rotation (bending) due to the actuation of other actuation pistons. The round with its nose 700 in the normal (aligned with the round body) configuration and in a tilted configuration are shown in FIGS. 17*a* and 17*b*, respectively.

The actuation piston design can be the same as the one shown in the close-up view of FIG. 16*c*. The actuation charges for actuating the actuation pistons can be positioned inside the bellow itself as previously described. The actuators would thereby enjoy the same advantages that were described in the previous section by requiring minimal volume and allow the use of small gas generating charges and accommodating relatively large number of charges.

As also described above, by biasing the nose section to return to its normal (round body aligned) configuration by the actuation pistons, only one actuation piston activation is still required for each nose-tilting operation. Similarly, by using three such actuation pistons, the nose can be tilted in three different directions by actuation a single actuator. When one actuator is actuated, the tilting of the nose will also slightly bend the other two actuation pistons, which they can readily tolerate due to the flexibility of their bellow structure. By actuating two of the actuation pistons at a time, the nose is tilted in a direction between the two actuated pistons. As a result, by using three actuation pistons, the nose section can be tilted in six different directions. Similarly, it is readily seen that by employing four actuation pistons, the nose section of the round can be tilted in twelve different distinct directions by actuating one, two or three actuation pistons at a time.

The control surface actuation devices described herein have very high dynamic response characteristics, since they are based on detonations of charges and utilization of the generated high detonation pressures to drive the actuation devices. For example, such a linear control surface actuator operating at a detonation pressure of around 5,000 psi and with a pressure surface of only 0.2 square inches (0.5 inch dia.) would readily provide a force of around 980 lbs or 4,270 N (which can still be significantly magnified via the inclined contact surfaces between the piston and the translating element of the actuator). A rotary actuator with a similar sized pressure area with an effective diameter of 2 inches and operating at 5000 psi could readily produce a torque of over 100 N-m. In addition, reliable detonation within time periods of 1-2 msec and even significantly lower with the aforementioned micro-J initiation devices can be achieved. Thereby, the peak force/torque can be achievable within 1-2 msec or less, providing control surface actuation devices with very high dynamic response characteristics that are ideal for guidance and control of precision gun-fired projectiles of different calibers and mortars.

As previously discussed, the bellow type actuation pistons have a number of advantages over piston type actuation elements and can be used in all control surface actuation devices. However, since such novel actuation pistons, particularly with integrated gas generating charges that are as much as possible positioned inside the bellow volume, are difficult to accurately model, an instrumented developmental test-bed has been developed that would allow for testing of various bellow type designs and arrangement of the gas generating charges. This instrumented test-bed is intended to be used to develop design rules and collect empirical data as to the predicted performance of such bellow type actuation pistons in terms of the amount of force that they can generate for a given amount and type of gas generating charge, the amount of time that is required to initiate and achieve full ignition, and range of piston displacement. These information and the resulting design rules and data that could be included in analytical models of the overall actuation device are required to enable the system designer to optimally design the required actuation device for the application at hand.

In addition to uses for projectile guidance systems, the mechanical stepper motors and actuators described above have other non-military uses. One such use is for emergency uses. The mechanical stepper motors and actuators disclosed above actuate by detonating gas charges, and as such, have the capability of generating large actuation forces. Consequently, such mechanical stepper motors can be used commercially in emergency situations that may require a large generated force and where a one-time use may be tolerated. For Example, the mechanical stepper motors and actuators disclosed above can be configured to pry open a car door after an accident to free a trapped passenger or pry open a locked door during a fire to free a trapped occupant. In another commercial use, the novel mechanical stepper motors and actuators disclosed above, being actuated by detonating gas charges, do not require an external power source for actuation, such as hydraulic pumps or air compressors. Accordingly, such mechanical stepper motors can be adapted for use in remote locations where providing external power to the device is troublesome or impossible. For Example, the novel mechanical stepper motors disclosed above can be used under water, such as at the sea floor, for example in connection with oil drilling platforms. The novel mechanical stepper motors and actuators disclosed above, due to their capability of generating large actuation forces, can also be used for heavy duty industrial applications, such as for opening and closing large valves, pipes, nuts/bolts and the like.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A munition comprising:

a control surface actuation device comprising:

an actuator comprising first and second pistons, each of the first and second pistons being movable between an extended and retracted position, the extended position resulting from an activation of each of the first and second pistons; and a rotatable plate having more than two pockets, each pocket being engageable with a corresponding portion of a respective one of the first and second pistons, a distance between adjacent pockets of the more than two pockets being different than a distance between the portions of the first and second pistons, such that activation of the portion into a respective pocket rotates the plate; and a control surface operatively connected to the plate such that rotation of the plate rotates the control surface.

2. The munition of claim 1, wherein the actuator comprises:

a bellows for movably housing each of the first and second pistons; and a plurality of gas generation charges generating a gas in fluid communication with the bellows;

wherein activation of each of the plurality of gas generation charges results in an increase in pressure in the bellows causing the piston to extend from the retracted to the extended position such that the portion extends into the corresponding pocket.

3. The munition of claim 1, wherein the control surface is a fin.

4. The munition of claim 1, wherein the munition further comprises a second control surface actuation device comprising:

another actuator comprising first and second pistons, each of the first and second pistons being movable between an extended and retracted position, the extended position resulting from an activation of each of the first and second pistons; and another rotatable plate having more than two pockets, each pocket being engageable with a corresponding portion of a respective one of the first and second pistons, a distance between adjacent pockets of the more than two pockets being different than a distance between the portions of the first and second pistons, such that activation of the portion into a respective pocket rotates the plate;

wherein the munition further comprises another control surface operatively connected to the another plate such that rotation of the another plate rotates the another control surface.

5. The munition of claim 4, wherein the another control surface is a fin.

* * * * *